United States Patent [19]

Holt

[11] 3,947,148

[45] Mar. 30, 1976

[54] FAN ASSEMBLIES

[75] Inventor: Paul Holt, Rugby, England

[73] Assignee: Chrysler United Kingdom Limited, London, England

[22] Filed: Nov. 26, 1974

[21] Appl. No.: 527,261

[30] Foreign Application Priority Data

Dec. 27, 1973 United Kingdom ..... 59802/73

[52] U.S. Cl. ..... 415/119; 415/174; 181/36 R

[51] Int. Cl.[2] ..... F04D 29/66

[58] Field of Search ..... 181/36 C, 36 D, 33 HA, 181/42, 36 R; 415/119, 174; 115/34

[56] References Cited

UNITED STATES PATENTS

| | | | |
|---|---|---|---|
| 2,028,985 | 1/1936 | Mahon | 415/119 |
| 2,225,398 | 12/1940 | Hamblin | 415/119 |
| 2,252,256 | 8/1941 | Harris | 415/119 |
| 2,749,024 | 6/1956 | Wilfert | 415/119 |
| 3,068,016 | 12/1962 | Dega | 415/174 |
| 3,321,931 | 5/1967 | Lehmkuhl | 415/119 |
| 3,346,174 | 10/1967 | Lievens et al. | 415/119 |
| 3,403,843 | 10/1968 | Cox | 415/119 |
| 3,735,593 | 5/1973 | Howell | 415/119 |
| 3,821,999 | 7/1974 | Guess et al. | 415/119 |
| 3,890,060 | 6/1975 | Lipstein | 415/119 |

FOREIGN PATENTS OR APPLICATIONS

| | | | |
|---|---|---|---|
| 1,600,841 | 10/1970 | France | 415/119 |
| 908,521 | 10/1962 | United Kingdom | 415/119 |
| 730,580 | 5/1955 | United Kingdom | 415/119 |

*Primary Examiner*—Henry F. Raduazo
*Attorney, Agent, or Firm*—Edward F. Connors

[57] ABSTRACT

The disclosure relates to a fan assembly including a duct in which an axial flow fan is mounted, there being a plurality of apertures formed in the duct wall around the fan and a layer of acoustic absorption material encircles the duct and projects through the apertures into the duct to have a minimum running clearance from the periphery of the fan.

9 Claims, 2 Drawing Figures

FAN ASSEMBLIES

BACKGROUND OF THE INVENTION

1. Field of the Invention

This invention relates to fan assemblies more particularly axial flow fan assemblies. One application of such fan assemblies is in cooling combustion engines such as automobile engines.

2. Description of the Prior Art

U.K. Patent Specification No. 967,100 describes a radial flow fan located in a casing which comprises an outer, gas-tight, wall of a flexible material, an inner, perforated wall of a rigid material such as sheet metal with an absorption layer of foamed or expanded plastics disposed therebetween.

The acoustic absorption material is effective to an extent in absorbing sound emitted by the fan and the casing construction could be applied to an axial flow fan. In the case of an axial flow fan a high-frequency sound is generated at the tips of the fan blades and although sound absorption material can, to an extent, absorb such frequencies, it is desirable to make a further reduction in the level of high-frequency sounds emitted from an axial flow fan assembly and that is the object of the present invention.

SUMMARY OF THE INVENTION

The invention provides a fan assembly comprising a duct, an axial flow fan located within the duct, the wall of the duct having a plurality of apertures spaced around the part of the duct encircling the fan, an acoustic absorption material encircling said part of the duct and projecting into the duct through said apertures to have a minimum clearance from the periphery of the fan.

The presence of the acoustic absorption material at a minimum clearance from the tips of the fan blades causes a reduction in the level of noise generated by the fan tips and also the presence of the sound absorption material immediately in contact with the air flow along the duct reduces the noise emitted by air flow along the duct. In the result an overall reduction in noise emitted is achieved compared with a casing constructed as described in the prior U.K. Patent Specification No. 967,100 referred to earlier.

DESCRIPTION OF THE PREFERRED EMBODIMENT

Figure 1:
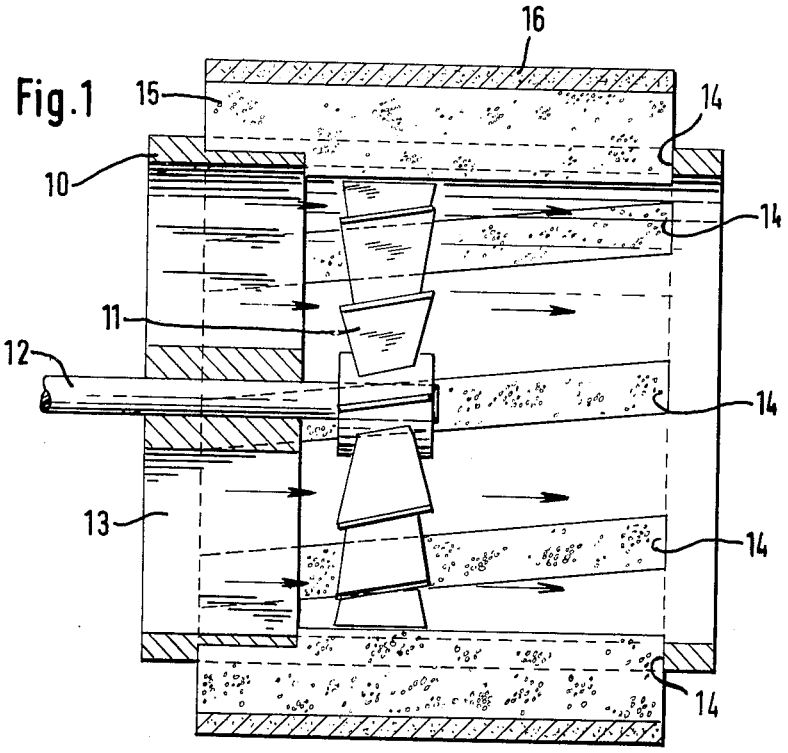
FIG. 1 is a cross-sectional view through a first fan assembly.

Referring firstly to FIG. 1 of the drawings there is shown a duct 10 for delivering cooling air to a radiator of a motor vehicle engine, the duct containing an axial flow fan 11 driven by a shaft 12. Stator blades 13 are mounted in the duct upstream of the fan. The part of the duct 10 encircling the fan and extending both upstream and downstream of the fan is formed with a number of circumferentially spaced elongate slots 14 extending along the duct at an angle to the axis thereof. The slots 14 project between the blades of the stator.

The part of the duct in which the slots are formed is encircled by a thicker layer 15 of an acoustic absorption material such as open cell polyurethane foam. The foam projects through the apertures 14 into the duct and has a minimum working clearance from the periphery of the fan. In order to minimise the clearance between the periphery of the fan and the projecting acoustic absorption material, the material can be pressed through the apertures until it just touches the tips of the fan blades which then cut a path through the material as soon as the fan is rotated.

The layer of acoustic absorption material is supported and encircled by an acoustic barrier material 16 such as a plastics, synthetic or natural rubber.

The noise created by the rotating fan blade tips is absorbed by the acoustic absorption material projecting through the apertures and the layer of acoustic absorption material encircling the duct and the acoustic barrier material further assists in reducing fan noise.

The apertures extend over a greater part of the length of the duct 10 as can be seen in FIG. 1 to assist in attenuating the noise induced in the duct by interaction between laminar and turbulent air flow along the inner surface of the duct. The angling of the apertures to the longitudinal axis of the duct presents a greater end-on length of sound absorption material to the direction of air flow.

Vehicles incorporating an embodiment of the invention have been subjected to tests in accordance with British Standard No. 3245:1966 which covers external noise test procedures. A repeated one third octave frequency analysis showed up to a 5 dB (A) reduction in sound pressure levels associated with the fan and ducting assembly at frequencies corresponding to a fan rotational speed in the order of 4,500 RPM compared to an un-insulated assembly, whilst the overall external noise level over the complete frequency test range showed a 1.25 dB (A) reduction compared with unmodified vehicles of the same type.

Figure 2:
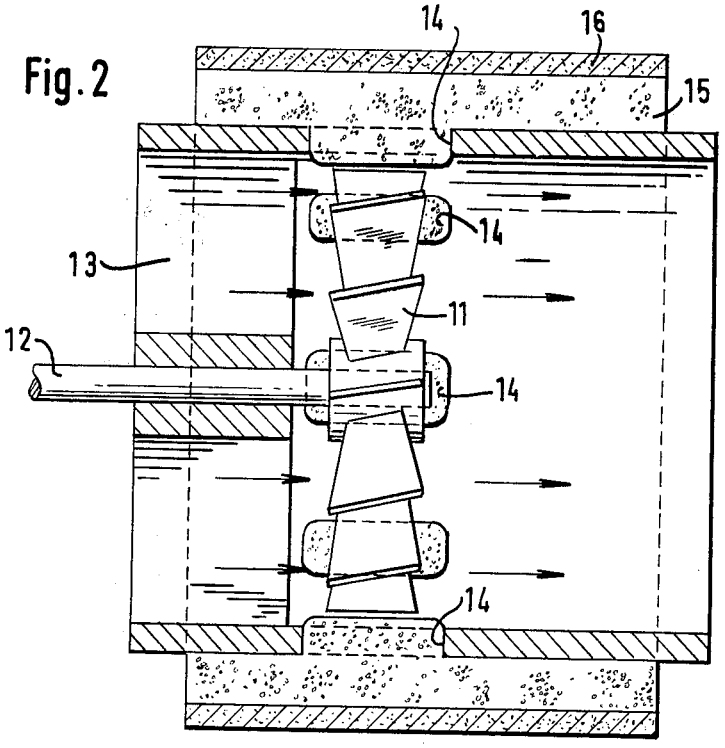
FIG. 2 is a cross-sectional view through a second fan assembly.

FIG. 2 of the drawings shows a similar arrangement employing shorter apertures which project only just upstream and downstream of the fan 11 and extend lengthwise of the duct. The arrangement is otherwise identical to that described with reference to FIG. 1.

I claim:

1. A fan assembly comprising a duct, an axial flow fan located within the duct and including rotor blades having outer tips, the wall of the duct having a plurality of radial apertures circumferentially spaced around at least the part of the duct encircling the fan, an acoustic absorption material encircling said part of the duct and having projecting portions extending radially inwardly through the apertures into the duct towards the fan axis, the projections terminating in radially inwardly directed end faces which lie in the path of rotation of the periphery of the fan in a manner to provide a minimum clearance between the projections and the tips of the rotor blades of the fan.

2. A fan assembly as claimed in claim 1 wherein the layer of acoustic absorption material is encircled by a layer of acoustic barrier material.

3. A fan assembly as claimed in claim 1 wherein the acoustic absorption material is an open cell polyurethane foam.

4. A fan assembly as claimed in claim 2 wherein the acoustic barrier material is a plastics.

5. A fan assembly as claimed in claim 1 wherein the apertures are elongate and extend along the duct both upstream and downstream of the fan.

6. A fan assembly as claimed in claim 5 wherein said apertures extend at an angle to the axis of the duct.

7. A fan assembly as claimed in claim 1 wherein the duct contains stator blades spaced around the inner periphery of the duct upstream of said fan and said apertures project between the stator blades.

8. A fan assembly as claimed in claim 2 wherein the acoustic barrier material is a synthetic rubber.

9. A fan assembly as claimed in claim 2 wherein the acoustic barrier material is a natural rubber.

* * * * *